US011773600B2

(12) United States Patent
Micciantuono

(10) Patent No.: US 11,773,600 B2
(45) Date of Patent: Oct. 3, 2023

(54) WALL PANELING SYSTEM

(71) Applicant: Bath Systems, LLC, Huntington, NY (US)

(72) Inventor: Thomas Micciantuono, Wesley Chapel, NC (US)

(73) Assignee: Bath Systems, LLC, Huntington, NY (US)

( * ) Notice: Subject to any disclaimer, the term of this patent is extended or adjusted under 35 U.S.C. 154(b) by 16 days.

(21) Appl. No.: 17/384,389

(22) Filed: Jul. 23, 2021

(65) Prior Publication Data

US 2023/0021420 A1 Jan. 26, 2023

(51) Int. Cl.
*E04F 13/08* (2006.01)

(52) U.S. Cl.
CPC ..... *E04F 13/0842* (2013.01); *E04F 13/0866* (2013.01); *E04F 13/0873* (2013.01); *E04F 13/0898* (2013.01)

(58) Field of Classification Search
CPC ... E04F 13/08; E04F 13/0801; E04F 13/0803; E04F 13/0841; E04F 13/0842; E04F 13/0866; E04F 13/0871; E04F 13/0873; E04F 13/0898; E04F 2015/02077
USPC ..... 52/470–472, 582.1, 586.1
See application file for complete search history.

(56) References Cited

U.S. PATENT DOCUMENTS 2,005,427 A 6/1935 Lenke
3,817,012 A 6/1974 Wack
4,289,818 A 9/1981 Cassamayor
4,299,064 A 11/1981 Daniels
4,671,026 A 6/1987 Wissinger
4,864,787 A 9/1989 Bukowski
4,947,608 A 8/1990 Donaldson
5,125,204 A 6/1992 Porter
7,424,754 B2 9/2008 Ingram
7,726,083 B2 * 6/2010 Wagner ..... E04F 13/142 52/285.3

(Continued)

OTHER PUBLICATIONS

Wetwall TM , a Wilsonart Company, Installation Guidelines, available on company website at: wetwall.com/installation; last visited Oct. 28, 2021.

*Primary Examiner* — William V Gilbert
(74) *Attorney, Agent, or Firm* — Pokalsky Wilczynski Brozek, LLP

(57) ABSTRACT

The present invention provides a wall paneling system that is completely mechanical and does not require the use of adhesives in attaching panels to the walls. The system comprises wall panels having a core with a decorative surface attached to one side and profiled edges that connect to each other by push click, panel connector clips (PCCs) that further connect and secure the interconnecting panels to the walls; and corner moldings for use in paneling adjoining walls meeting at a corner via tongue and groove. The PCCs and corner moldings attach to the walls by mechanical fastening and provide an air space between the walls and the wall panels. Since the wall panels are not directly connected or adhered to the wall, the system allows the panels to be easily replaced by removing and inserting from the PCCs and corner moldings. By using specially adapted bottom seals, seals in the corner moldings and sealant between the panels, the paneling system can be made impermeable to water and is therefore especially useful in area wet areas such as bathrooms.

21 Claims, 7 Drawing Sheets

(56) References Cited

U.S. PATENT DOCUMENTS

| | | | | |
|---|---|---|---|---|
| 7,874,118 | B2 | 1/2011 | Schitter | |
| 8,042,309 | B2 | 10/2011 | Wolf | |
| 8,590,249 | B1 * | 11/2013 | Loper | E04F 13/0848 52/285.3 |
| 8,793,956 | B2 * | 8/2014 | Leopolder | E04F 13/08 52/592.1 |
| 8,887,462 | B2 | 11/2014 | Tatari | |
| 8,979,052 | B2 * | 3/2015 | Uota | E04F 13/0801 403/381 |
| 9,051,736 | B2 | 6/2015 | Geels | |
| 9,080,331 | B2 | 7/2015 | Aboukhalil | |
| 9,200,459 | B2 | 12/2015 | White | |
| 9,297,167 | B1 | 3/2016 | Stockton | |
| 9,695,856 | B2 | 7/2017 | Maertens | |
| 9,745,758 | B2 | 8/2017 | Baert | |
| 10,041,258 | B2 * | 8/2018 | Pervan | E04F 15/10 |
| 10,273,697 | B2 | 4/2019 | Horton | |
| 10,544,595 | B2 | 1/2020 | Courey | |
| 10,704,269 | B2 | 7/2020 | Whispell | |
| 10,736,469 | B2 | 8/2020 | Allen | |
| 2002/0194807 | A1 | 12/2002 | Nelson | |
| 2006/0179764 | A1 * | 8/2006 | Ito | E04F 13/0821 52/510 |
| 2006/0265988 | A1 * | 11/2006 | Fujito | E04F 13/0803 52/506.05 |
| 2010/0186333 | A1 | 7/2010 | Miller | |
| 2011/0094177 | A1 * | 4/2011 | Licciardi | E04F 13/142 52/582.1 |
| 2015/0121774 | A1 | 5/2015 | Oy | |
| 2017/0298971 | A1 | 10/2017 | Maertens | |
| 2019/0078329 | A1 | 3/2019 | Ulici | |
| 2020/0131782 | A1 | 4/2020 | Midorikawa-Haelters | |
| 2022/0307271 | A1 * | 9/2022 | Ikeda | E04F 13/0898 |

* cited by examiner

WALL PANELING SYSTEM

BACKGROUND OF THE INVENTION

Tiled walls can be purely decorative or can also serve as a waterproof barrier between a wet area and one or more walls. Often found in bathrooms, laundry rooms and kitchens, tiled walls are especially useful in protecting walls from water used in a tub, shower, stove, and/or sink area. Usually made of a hard material such as porcelain or ceramic, tiles are normally attached to the walls by imbedding in mortar with grout placed between the tiles. Whether in new construction or in renovation, removal and installation of traditionally tiled surfaces is labor intensive, expensive, messy, and disruptive. In recent years, various wall covering systems have come into use such as wall surrounds and panels, which do not require mortar or grout. There are also drawbacks to these available types of wall coverings, which the present invention overcomes.

SUMMARY OF THE INVENTION

The present invention provides a wall paneling system that is easy to install and can be installed virtually anywhere in a dwelling or building. The system is completely mechanical and does not require the use of adhesives to attach panels to the walls. By using specially adapted seals and sealants, the paneling system can also be made waterproof and is therefore especially useful in areas where a waterproof barrier between a wet area and a wall is desired, such as in bathrooms, laundry rooms, and kitchens.

The various components of the system provide an air space between the wall and the wall panels. This air space allows walls to expand and contract normally, while not affecting the wall panels. The wall panels can also expand and contract independent of the walls to which they are mechanically attached. The ability of the wall panels and walls to expand and contract independently of each other helps preserve the integrity of the seals and sealants used when the wall paneling system is made impermeable to water. The air space between the walls and wall panels also allow humid air to better circulate, thus avoiding mold and mildew between the wall panels and the wall.

The wall paneling system does not require any visible caulking or visible sealant. Since adhesives are not used in securing the panels to the walls, there is no need for bracing to hold panels in place while an adhesive dries. Accessories such as soap dishes, shelving and shower doors can be installed immediately and will not require 24 hours waiting prior to first use. When using the specially adapted seals provided by the present invention, once the installation is complete, with sealant applied, the paneled area is waterproof and ready for use since there is no caulking or adhesive that requires drying time. The paneling system of the present invention may be installed directly to a raw plywood wall without having to be attached to a floor joist or wall stud and without the need for drywall, green board or cement board. The paneling system of the present invention may even be installed over existing tile or any other type of substrate so long as proper fasteners are used to fasten the various components of the wall paneling system to the wall.

Although the paneling system of the present invention is particularly useful in bathrooms, the system may also be used in other areas of a house or building, e.g., kitchens, laundry rooms, finished or partially finished basements, hallways and foyers. The wall paneling system of the present invention may also be used in larger settings such as in building corridors, airports, locker rooms, school classrooms and hallways, auditoriums, houses of worship, stores, and sports arenas, to name but a few. In many of these settings, the wall paneling system does not necessarily have to be made waterproof and therefore use of the specially adapted seals is optional.

The wall paneling system of the present invention may be used to cover one or more entire walls or to cover only a partial area of one or more walls, e.g., a backsplash behind a sink or stovetop, or a paneled lower half of a wall. Thus, the paneling system of the present invention may be applied anywhere a hard, decorative material is required or desired to be applied to one or more walls. The wall paneling system of the present invention may also be used to cover walls outside of a house or building, such as e.g., in an outdoor shower or in a cabana.

Broadly, the present disclosure describes embodiments of a wall paneling system that connects to a vertical surface, such as one or more walls of a room. The wall panels of the present invention are connected to the walls via panel connector clips (PCCs), which run along the vertical and/or horizontal axis of a wall and are mechanically fastened thereto. The wall panels mate to each other as well as mating to the PCCs.

In its simplest embodiment, a single wall panel is connected to two PCCs, each PCC placed on an opposite vertical or horizontal edge of the wall panel and the PCCs are mechanically fastened to the wall. Finished edges may be provided by inserting trim molding with finished edges into each PCC on the side not engaged with the wall panel. Thus, a single wall panel may be attached to the wall with or without trim molding having finished edges. If the wall area needs to be made waterproof depending on the width of the wall area to be covered, a corresponding length of a specially adapted bottom seal is first applied to a horizontal surface, such as the edge of a floor where it meets a wall, tub ledge, or shower pan edge, followed by application of a sealant on top of the bottom seal. Where a greater wall area is to be covered, instead of adding trim, additional panels may be serially added by connecting to the edge of a previously installed panel and PCC. Thus, PCCs are attached along the vertical or horizontal axis of a wall. When the PCCs and wall panels are attached along the vertical axis of a wall, each panel will be connected to a PCC and another panel, side by side, going across a wall, for example in the left and/or right direction. When the PCCs and wall panels are attached along the horizontal axis of a wall, the panels are laid one over the other, going up a wall, usually from bottom of the wall to the top of the wall, towards the ceiling. This is discussed in greater detail below.

Where more than one wall will be covered such as in adjoining walls, the wall paneling system provides corner moldings, which run vertically and are mechanically fastened to the ends of one or both walls meeting in an interior or exterior corner. The wall panels mate to each other and one PCC on one edge, as well as mating to the inside or outside corner molding on their opposite edge. Alternatively, opposite vertical edges of a single wall panel can mate to two separate inside corner moldings.

Because the wall panels are not directly connected or adhered to the wall, the system allows for the panels to be easily replaced by inserting or removing from the PCCs and corner moldings. This feature is important for addressing any needed plumbing repairs or for decorative design changes. The corner moldings, PCCs, and seals are completely hidden behind the decorative face of the wall panels after installation and there is no grout, caulking or sealants to maintain over the years.

DETAILED DESCRIPTION OF THE PREFERRED EMBODIMENTS

The following detailed description includes exemplary implementations of the invention. The description merely defines the general principles of the invention and is not intended to limit the invention, but should include other alternatives of which one of ordinary skill in the art will become aware from an understanding of the details of the following disclosure.

Figure 1:
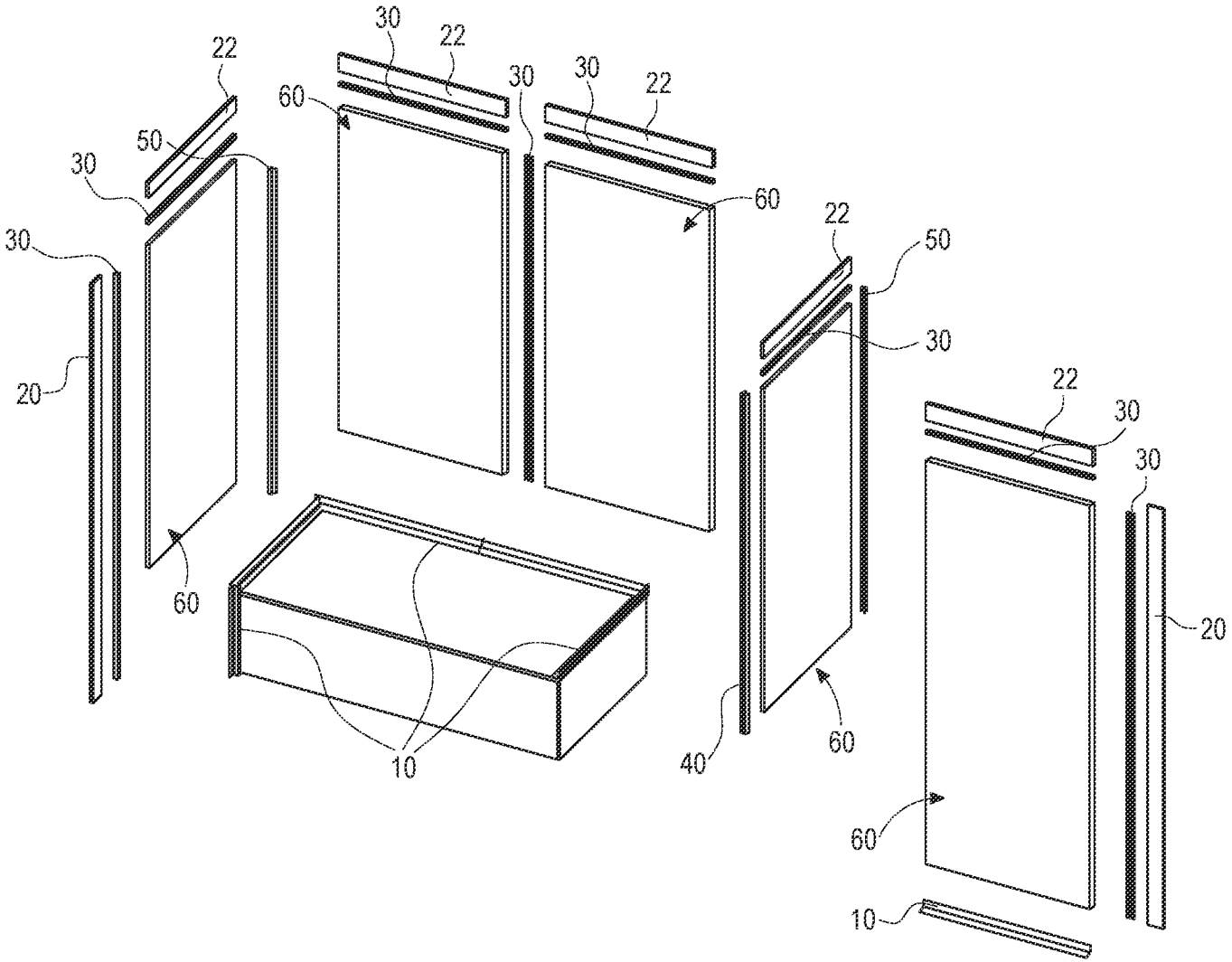
FIG. 1 is a schematic diagram showing an exploded view of one embodiment of the wall paneling system, where the walls surrounding an alcove tub are paneled. Both vertically placed and horizontally placed PCCs are visible.

With reference to FIG. 1, one embodiment of the invention is illustrated therein of a bathing area that is surrounded by three side walls, sometimes referred to as an alcove tub installation. In this embodiment, the bathing area includes a tub resting on a floor. Another embodiment comprises a shower stall, comprising three walls, sometimes referred to as an alcove shower installation. Alternative configurations include tub/shower combinations, shower stalls including corner shower stalls with two walls, and whirlpool baths. Further, the bathing area could comprise any of various known shower and/or tub configurations such as step up tubs, sunken tubs, zero entry showers, walk-in tubs, etc. The wall paneling system may also be used in a wet room, which is a type of bathroom where the shower is not enclosed within a shower door, shield, or curtain, and where there is no shower tray or basin. In this embodiment of the invention, a system of interlocking planks or panels is used to cover the walls to provide a waterproof barrier and a desired aesthetic appearance for the bathing/showering area.

As depicted in FIG. 1, because the area to be paneled around a tub needs to be made waterproof, a bottom seal 10 is installed to extend along an upper ledge of a tub, closest to the wall. The bottom seal may also be installed to extend along a top of a shower tray at an edge closest to and adjoining a wall, or at the juncture of where the shower floor meets the shower wall, e.g., in a wet room. As used herein and as well known in the industry, a shower tray may also be referred to as a shower base, or shower pan.

The bottom seal 10 may be made of a rubbery material such as butyl putty or ethylene propylene diene monomer (EPDM) putty, silicone rubber or any rubber foam seal type of material, which materials are readily available. The rubbery bottom seal fills in any slight imperfections on the surface of a tub ledge, counter top, top rim or surface of a shower base, or top of a floor surface, and provides an environment impervious to water. The bottom seal 10 is formed with a specific profile to mate with the lower back portion (wall-facing side) of a wall panel 60 and can either come in standard set lengths, or can be cut to a desired length on site.

Figure 4:
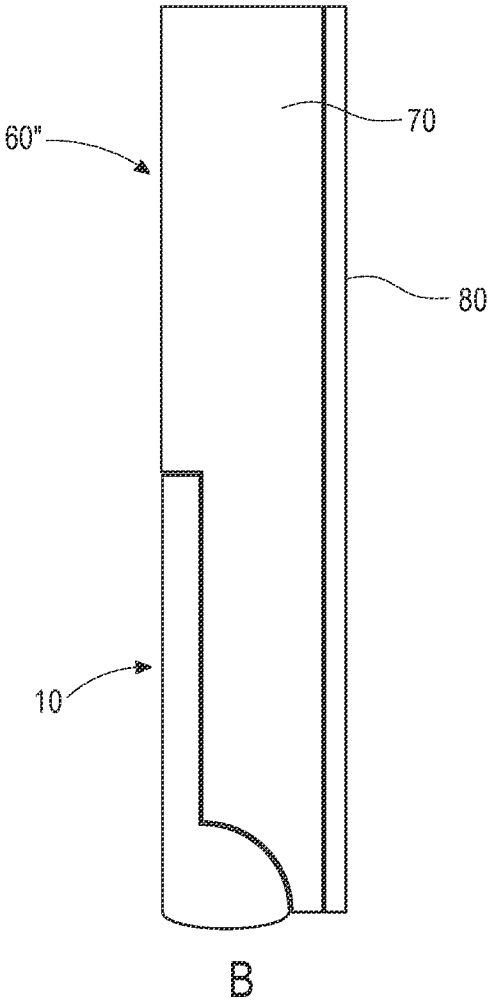
FIG. 4A is a schematic diagram showing detail of a bottom seal.
FIG. 4B shows a side view of a wall panel profiled to fit to a bottom seal.
Figure 4:
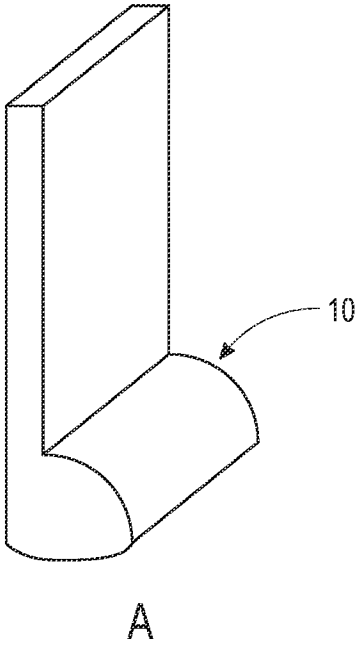

As shown in FIG. 4, the bottom seal 10 has a lower portion that is wider than a top portion, the top portion extending from the bottom portion vertically. This lower portion that is wider than an upper portion is due to the lower portion having a radius or rounded profile. The lower portion of the bottom seal 10 is configured to accept a panel 60''' and prevents water from going behind the panel 60'''. As can be seen in FIG. 4, the lower portion of the wall facing side of a wall panel is specifically profiled to rest upon the bottom seal. As also shown in FIG. 4, the back side of the bottom seal (side facing wall) and lower side of the bottom seal (side facing tub ledge, top rim or surface of a shower base, top of floor surface or counter top), have a self-stick adhesive applied. Examples of such adhesives include but are not limited to modified acrylic adhesives specifically designed to make bonding easy to almost any substrate, including but not limited to polyurethane (PU) ether, PU ester, cross-linked polyethylene (PE) foam, EPDM foam, neoprene foam, nitrile foam, microcellular urethane, neoprene rubber, butyl rubber and very high bond (VHB) tape, all of which are readily available. However, use of a bottom seal is not necessary when applying panels to walls that do not have to be made waterproof. If a bottom seal is not being used, then the lower portion of a wall panel does not need to be profiled to rest upon the bottom seal.

Figure 5:
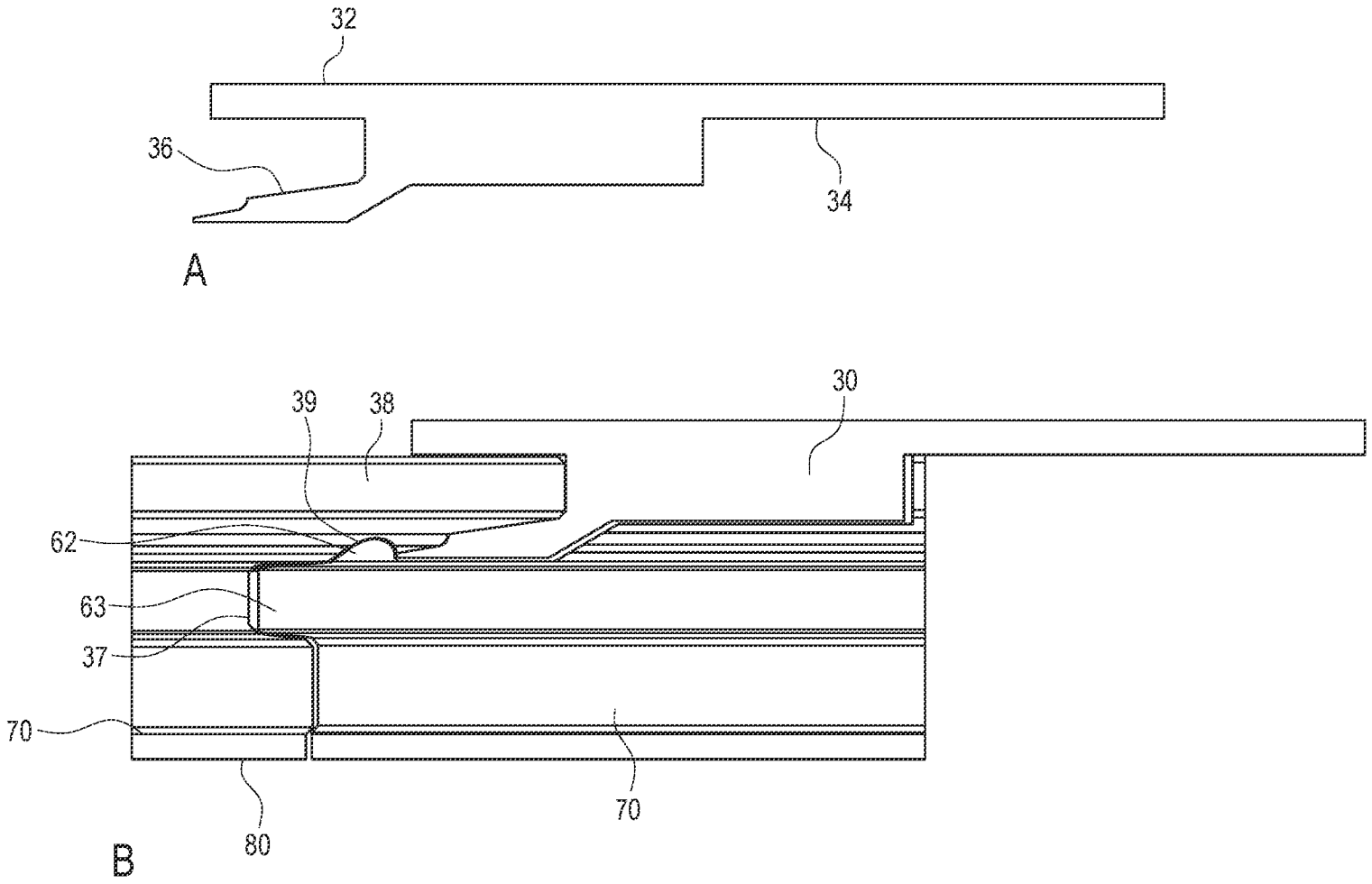
FIG. 5A is a top view of a panel connector clip (PCC).
FIG. 5B shows a top view of two wall panels fit to the PCC as well as joined to each other.
Figure 6:
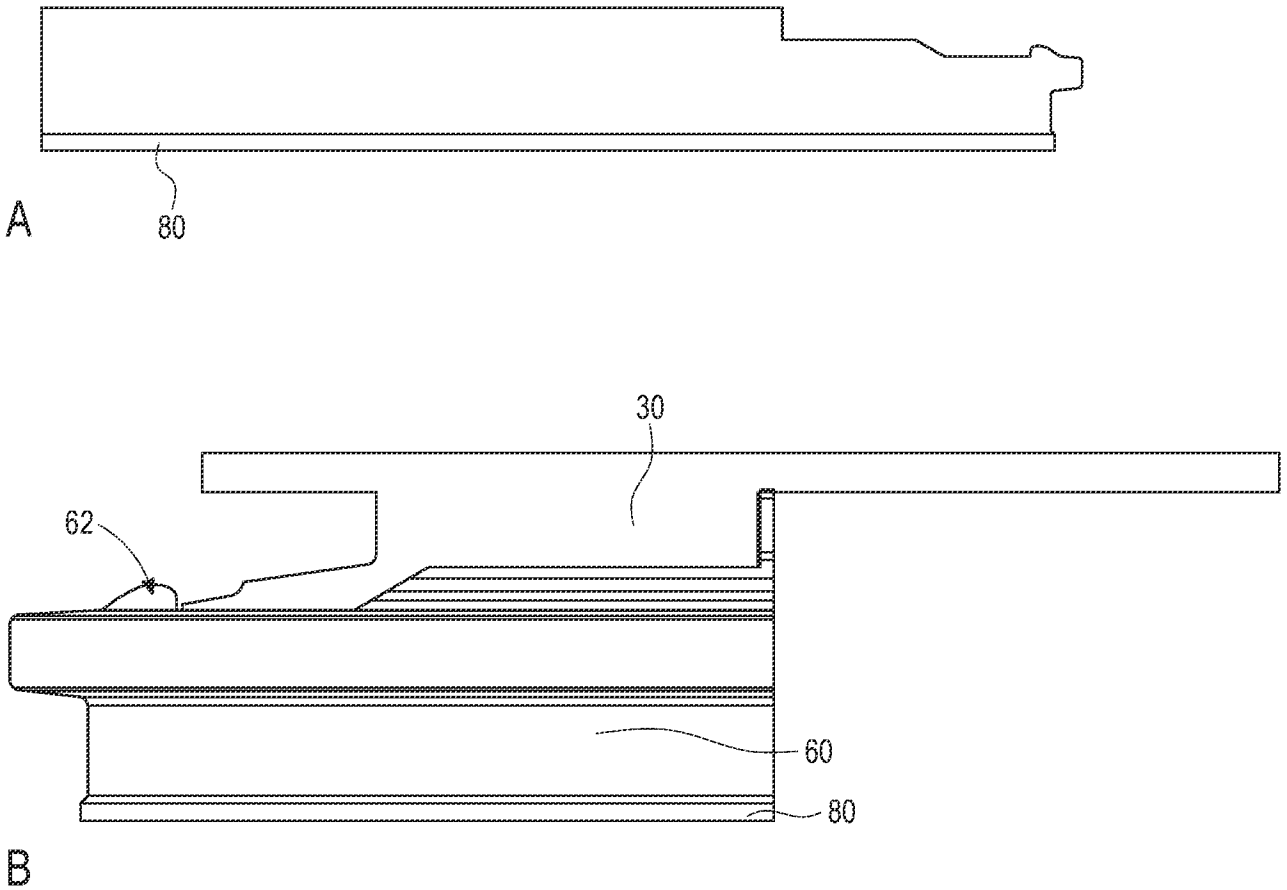
FIG. 6A is a top view of a panel showing the push click profile.
FIG. 6B is a top view of a PCC with a panel resting on the PCC and the panel's protrusion which is used to lock into a corresponding recess of another panel.
Figure 7:
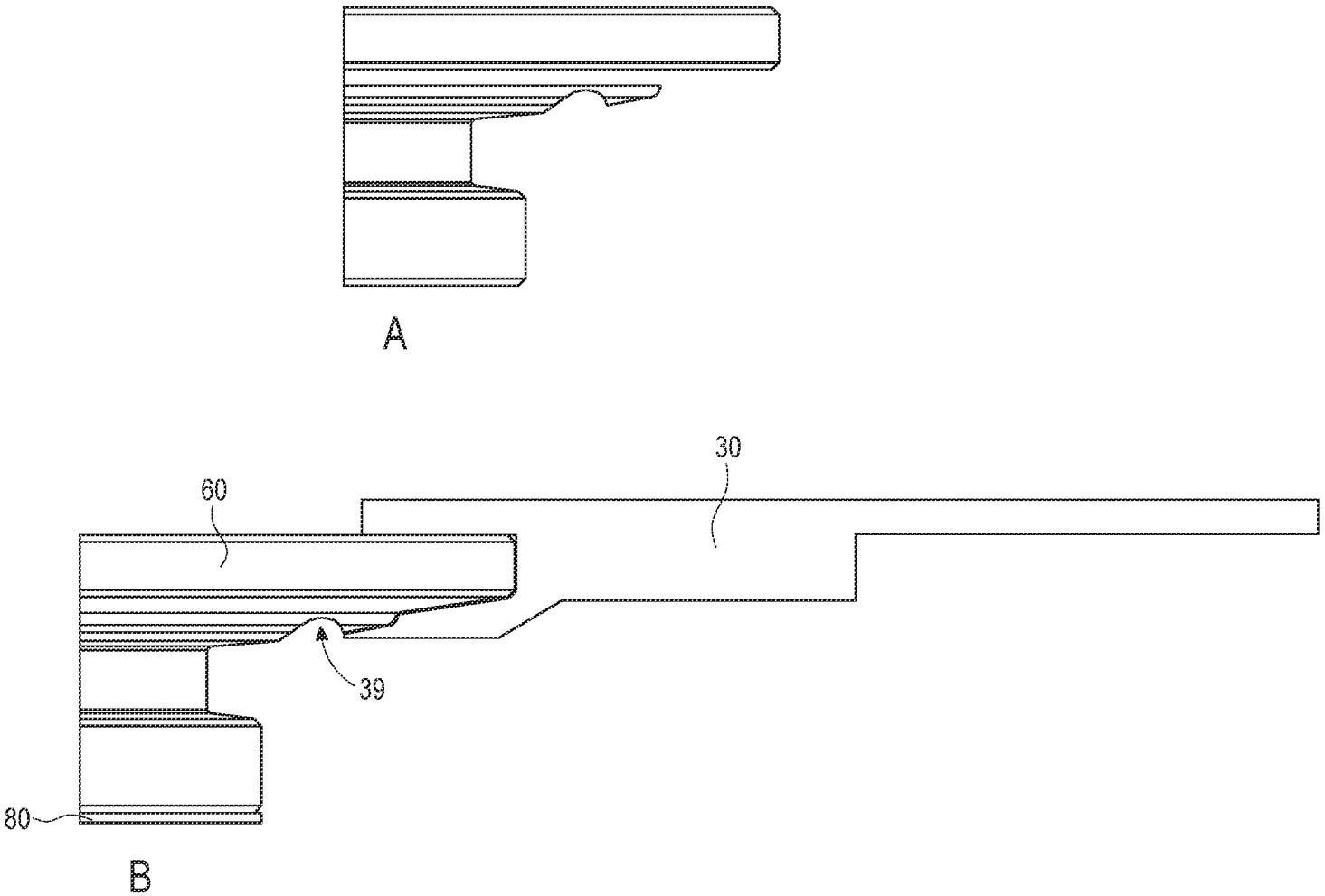
FIG. 7A is a top view of a panel to be inserted between the front extension portion and tongue portion of a PCC.
FIG. 7B shows the same panel inserted between the front extension and tongue portion of the PCC. The recess of the panel which locks into a protrusion on another panel is visible. Also visible is a second recess on the same panel, into which a lip portion of another panel is inserted.

As shown in FIGS. 5-7, a PCC 30 is used to connect one edge of a panel 60 to another edge of a panel 60 and to attach the connected panels to a wall, while maintaining an air space between the panels and the wall. The PCC 30 is adhered to the wall using strong adhesion, preferably using mechanical fasteners including but not limited to nails, bolts, screws, anchors, and rivets. The PCC 30 includes a front extension portion 32 (FIG. 5), a back extension portion 34 (FIG. 5) and a tongue portion 36 (FIG. 5). The PCC 30 may be made from a variety of materials such as wood, plastic, PVC, etc. Preferably, a PCC 30 is made of extruded aluminum, plastic, or stamped metal. It may also be 3D printed. Preferably, a PCC is fabricated with openings for mechanical fasteners. The PCC helps maintains an air space between the panels and the walls, which air space allows for movement of the walls independent of the wall panels and therefore without disturbing the connected wall panels.

A panel 60 (FIG. 1) is composed of a lightweight material including but not limited to polyvinyl chloride (PVC) foam board, wood, wood composite, calcium carbonate PVC, PVC marble, etc., which forms the core 70 (FIG. 5) of the panel and which defines a wall facing side of the panel. Preferably, the panel core is made of PVC foam board. The panel core has a thickness in the range of from about 1% to about 1 inch, preferably about 1%2 inch to about 34 inch. A decorative surface 80 (FIG. 5) is applied to one side of the panel and defines the visible decorative side of the panel. Examples of decorative finishes include but are not limited to porcelain, PVC marble, natural stone, plastic laminate, or any thin sheet decorative material having a thickness in the range of about 1.5 mm to about 6 mm and having a smooth or textured finish. Preferably, the thickness of the decorative surface is 3 mm or 6 mm. The decorative finish may be adhered to the core of a panel via peel and stick foam tape, such as VHB (very high bond) tape or any adhesive transfer tape.

The decorative side of the wall panels can be marked on site with tape, pencil, pen or marker at a location coinciding with plumbing connections, e.g., faucets, shower heads, fixtures, drains, etc., or at a location for fastening shower door or shower curtain rod hardware. Alternatively, this marking may be done during manufacture, e.g., after adhering the decorative finish to the core of the panels. Either or both sides of a panel may be so marked to aid in drilling through the panel to accommodate access to plumbing connections and/or hardware. Preferably, the panels will be pre-cut or pre-drilled during manufacture to accommodate plumbing connections and/or hardware.

Each panel can be manufactured to any width and length. Typically, panels can be manufactured in widths anywhere from about 3 inches to about 72 inches. For example, trim molding 20, 22 (FIG. 1) can be made at the lower part of this range, e.g., 3 inches wide. Preferably, wall panels have widths of about 32 to about 36 inches wide. Panel lengths are usually anywhere from about 6 to about 12 feet, with about 9 to about 10 foot lengths and about 12 foot lengths being common, and can be trimmed on site. Lengths for trim 22 and trim molding having finished edges 20 can be about 8 to about 9 feet and can also be trimmed on site. Preferably, panels are manufactured to a specific size before having the edges profiled. As used herein, the term "trim" can mean trim without finished edges, or trim (molding) with finished edges. When PCCs and wall panels are attached along a wall's vertical axis, the horizontal bottom edge of each panel is profiled to accept the bottom seal 10 (FIGS. 1, 4), unless the area being paneled does not need to be made impervious to water, in which case the horizontal bottom edge of each panel does not need to be so profiled. Where wall panels and PCCs are attached to a wall along the wall's horizontal axis, only the panels which rest upon the bottom seal will need to have their horizontal edges profiled to accept the bottom seal. Again, if the area being paneled does not need to be made waterproof, a bottom seal does not have to be used and panel edges will not need to be so profiled.

Wall panels have core edges on two opposite sides profiled so that they connect to each other or to trim 22 or trim molding with finished edges 20 as well as to the PCCs. When the panels and PCCs are applied along a wall's vertical axis, some wall panels will have one vertical core edge profiled to connect to another panel and PCC and the opposite vertical core edge profiled to connect to a corner molding. The topmost horizontal core edges of panels applied along a wall's vertical or horizontal axis may also be profiled to attach to a PCC 30 and trim 22 (FIG. 1). Trim and trim molding are made of the same core material as the wall panels, in the same thickness, and can have the same or different decorative surface applied. When the panels and PCCs are applied along a wall's horizontal axis, some wall panels will have a longer, horizontal core edge profiled to connect to another panel and PCC and one or more shorter adjacent core edges profiled to connect to corner moldings or vertically placed PCCs.

Specialized tenoners with diamond saws are well suited for profiling the wall panels, e.g., those made by Homag or Reignmac. The decorative face of the panel can be applied to the panel core either before or after profiling the edges.

As shown in FIGS. 5 and 7, the front extension portion 32 of the PCC ensures that a first panel 60 (FIG. 7) inserted into the PCC 30 is spaced a first predefined distance from the wall. Each panel, including the first panel 60 applied (FIG. 7), has a front portion 38 (FIG. 5) that is disposed between the front extension portion 32 and the tongue 36 of the PCC (FIG. 5). This front portion 38 of a first panel has a first recess 39 (FIG. 7) that is configured to mate with a corresponding protrusion 62 (FIGS. 5, 6) of another e.g., second panel. When panels are serially applied to a wall along its vertical axis, except for the first panel (which will have each of its vertical edges profiled to have a recess), each panel in the series will have one vertical edge with a protrusion 62 (FIGS. 5, 6) and one vertical edge with a corresponding recess 39 (FIGS. 5, 7) so that they can be connected to each other as well as to the PCC. Likewise, when panels are serially applied to a wall along its horizontal axis, except for the first panel (which will have each of its horizontal edges profiled to have a recess), each panel in the series will have one horizontal edge with a protrusion 62 (FIGS. 5, 6) and one horizontal edge with a corresponding recess 39 (FIGS. 5, 6) so that they can be connected to each other (or trim, trim molding) as well as to the PCC (FIG. 5).

As shown in FIG. 6 (and FIG. 5), a second panel 60 is configured to rest on the back extension portion 34 of the PCC 30, and spaced the same first predefined distance from the wall so that the first and second panels are both spaced from the wall the first predefined distance. Preferably, this predefined distance is in the range of from about 1/16 to 1/8 inch and is determined by the depth of the front extension portion 32 of the PCC. The second panel 60 also rests on top of the tongue 36 of the PCC.

As shown in FIG. 5, the tongue 36 of the PCC 30 keeps a first panel locked to the wall, and the first recess 39 of the first panel holds a second panel to the first panel via the second panel's protrusion 62 (FIGS. 5, 6). Moreover, the second panel is also secured to the first panel by a lip 63 (FIG. 5) of the second panel being inserted into a second recess 37*a* of the first panel (FIG. 7). The wall panels are connected by click joint technology (see 39 and 62, FIG. 5), also known as push click technology or click lock technology (hereinafter referred to as push click), similar to that used in wood floor assembly. The unique design of the push click profiled panels also accommodates the PCC to attach the connected panels to the wall. Thus, the panel core edges are profiled for connecting to each other, to trim and to the PCCs via push click, and in some instances for connecting into corner moldings via tongue and groove.

Most push click assembly systems require 3/8-inch space between panels or planks and often require a plank or panel to be held at an angle to an adjoining plank or panel, followed by clicking or pushing to join (also known as "angling and snapping"). In the present invention, the panels may be vertically aligned side by side with as little as 1/8-inch (about 3 mm) space between panels. The importance of this space saving feature is especially appreciated in smaller bathroom settings. For example, usually only two wall panels are applied (along a wall's vertical axis) to the widest wall of an alcove tub installation, i.e., the back wall (FIG. 1). A typical alcove tub is around 60 inches long. If each wall panel is about 32 inches wide, there is very little space between the panels, e.g., about 3 mm. Further, in the present invention, there is no need for panels to be held and inserted at an angle before pushing and clicking to join. The minimal spacing requirements and the ability to push (slide) the panels together to join with each other and with a PCC while aligned flat and not held at an angle is an advantage since the panels can be quite large and heavy e.g., a 3 foot by 8-foot panel could weigh 150 pounds, and angling and snapping would be a much more difficult maneuver.

The foregoing describes various components of the wall paneling system and method of connecting panels to each other and to a wall. To accommodate a wall corner or a wall end, the present invention also provides inside corner moldings 50 and outside corner moldings 40, as shown in FIG. 1.

Figure 2:
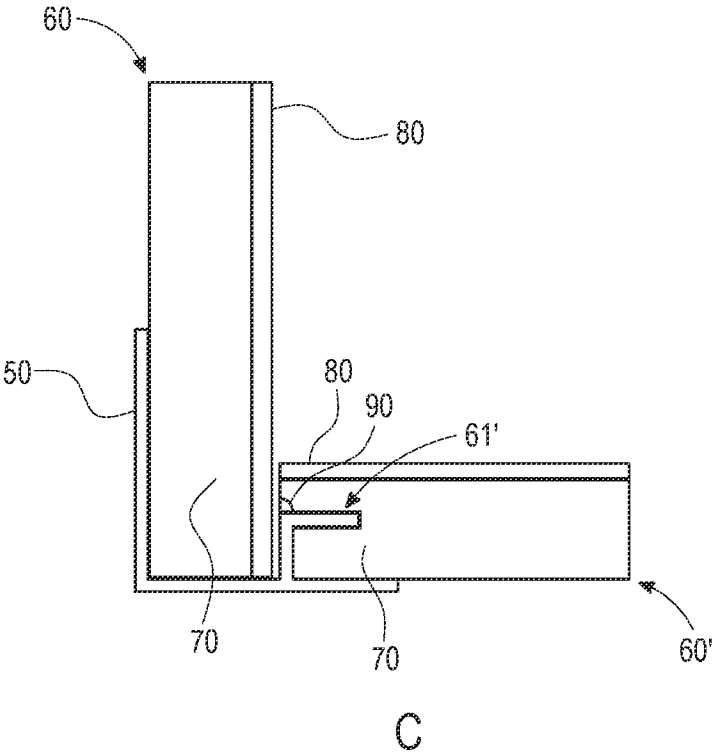
FIG. 2A is a diagram showing detail of an inside corner molding which may be used in the wall paneling system.
FIG. 2B is a profile of the inside corner seal. A top view (looking down) of the inside corner molding with panels and inside corner seal inserted is also shown in FIG. 2C.
Figure 2:
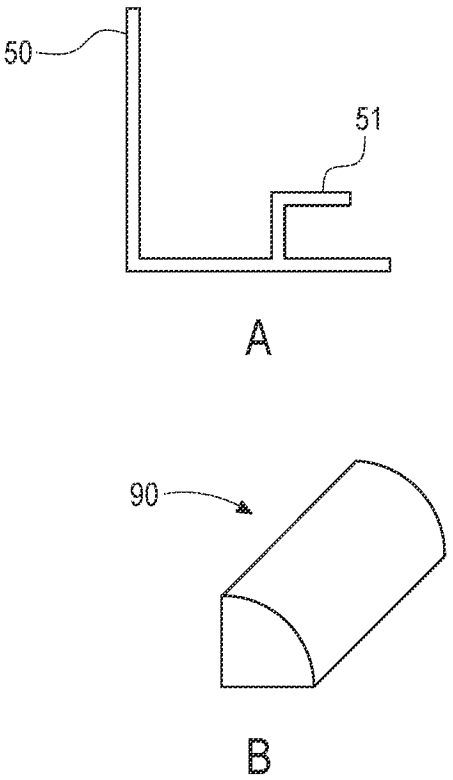

As shown in FIG. 2, the inside corner molding 50 is a piece that extends vertically along the interior (inside) corner of two adjoining walls and has two perpendicular sides forming a right angle, each side fastenable to one or both adjoining walls, with a tongue portion 51 extending from and parallel to one side of the inside corner molding 50. This molding may be made in various sizes depending on the thickness of the decorative surface material, e.g., 3 or 6 mm decorative finish. The inside corner molding 50 is adhered to one or both adjoining walls via mechanical fastening, square and plumb to the tub, shower pan or floor and wall surface. As such, the corner moldings allow the panels to be joined in the corners perfectly square and plumb to correct any inconsistency in the corners of the walls. A panel 60 will have one core edge profiled so that the end will fit into the inside corner molding piece 50 flush on the one side of the corner molding that has the tongue 51 extending therefrom. A second panel 60' (FIG. 2) will be profiled to have a slot (groove) 61' (FIG. 2) cut therein along the length of the panel core edge in order to receive the tongue 51 of the corner molding 50. The corner moldings extend from the wall by 1/16 to 1/8 of an inch, allowing for air space between the wall and corner molding. Similarly, the PCCs extend from the wall by 1/16 to 1/8 of an inch, also allowing the same amount of air space between the wall and PCC.

If the wall panels are being applied for use in a wet environment such as a bath or shower area, another portion in the core of the second panel 60' will be cut along the length of its vertical edge to receive an inside corner seal 90. This second recess is made alongside and abuts the groove that receives the tongue of the inside corner molding. Examples of materials that may be used for the inside corner seal include but are not limited to butyl putty/sealant, silicone rubber and EPDM (supplied in rolls or cut lengths). During installation, and as shown in FIG. 2, a self-stick inside corner seal 90 is applied to the small cutout (recess) described above made along the core edge of a panel. The seal can be rounded or angular. Preferably, the seal is a wedge with the shortest edge rounded, i.e., a pie-shaped wedge 90 (FIG. 2). Accordingly, the cut or profile made in the core of the panel edge is specific to accommodate such a seal. Prior to inserting the panels in an inside corner molding 50, a sealant is applied to one or more areas of the inside corner molding 50 as a second line of defense from moisture penetration. Preferably, the sealant is applied to the entire surface of the inside corner molding 50. A sealant is also applied to the very narrow groove (space) anywhere two panels meet 37 (FIG. 5) after connecting to a PCC. Thus, for example, when paneling walls in a wet area, a sealant is run along the length of the narrow groove (space) between panels 37 (FIG. 5) and any excess sealant is wiped away.

Examples of sealants include but are not limited to latex, silicone grease, lithium grease and silicone sealant, such as the type used in the marine industry. In a preferred embodiment, silicone grease is used. The sealant allows for expansion and contraction of a room's walls without losing the water impervious seal of the wall panels connected to each other and attached to the wall via the PCCs. Because the wall panels are connected to the walls via the PCCs and not directly to the walls, any minute movement of the walls will not disturb or disrupt the sealants and seals between the panels, corner moldings, and PCCs.

In accordance with the present invention, there is also provided a method of paneling an interior wall to make it impervious to water (waterproof). The method comprises, first applying a bottom seal 10 to the top surface of a tub, floor, counter top or shower tray, at an edge closest to a wall to which a panel will be applied. As described above, and as shown in FIG. 4, the back side of the bottom seal (wall-facing side) and lower side of the bottom seal (side facing top of tub, shower, counter top or floor), have a self-stick adhesive applied. Examples of such adhesives include but are not limited to butyl tape or ethylene propylene diene monomer (EPDM) adhesive transfer tapes, which are readily available. The malleability of the bottom seal fills in slight imperfection on the surface of the tub, shower basin, pan or floor and provides a water-impervious environment surrounding the bottom seal. If there is an interior corner, an inside corner molding 50 is installed by adhering it to one or two adjoining walls via mechanical fastening. A sealant such as silicon grease, is applied to the rounded profile (radius) 10 of the bottom seal (FIG. 4) before applying panels. A panel 60 (FIG. 2) with a profiled edge that will fit into the inside corner molding piece 50 flush on the one side that has the tongue portion extending therefrom 51, is inserted. A second panel 60' will have a profiled edge with a slot (groove) 61 cut in its core to receive the tongue 51 of the inside corner molding. Another portion of the core of the second panel 60' (FIG. 2) will be cut to receive an inside corner seal 90. This recess that receives the inside corner seal abuts the groove that receives the tongue of the inside corner molding. This seal is inserted to run the length of the panel 60'. The order of insertion into the inside corner moldings may be reversed, i.e., the first panel to be inserted may have an edge profiled with a slot to receive the tongue portion of the inside corner molding and the second panel to be inserted may be profiled to fit into the inside corner molding flush on the one side that has the tongue portion extending therefrom.

Figure 3:
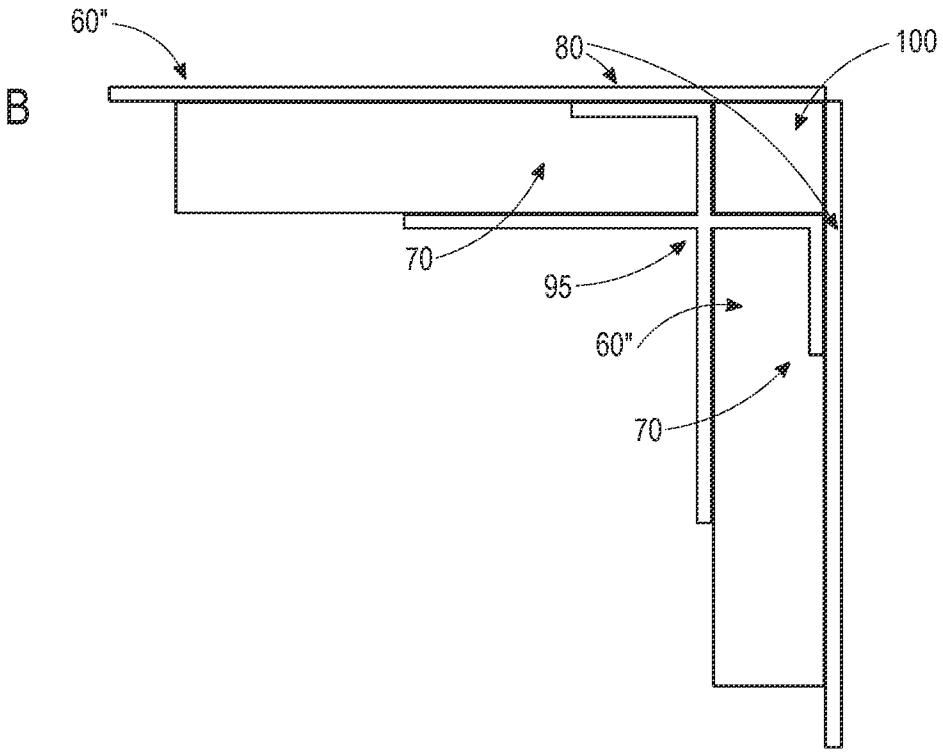
FIG. 3A is a top view showing detail of an outside corner molding used in an embodiment of the wall paneling system.
FIG. 3B is a top view of two wall panels meeting at an exterior corner and inserted into the outside corner molding. An outside corner seal inserted into a square shaped channel formed by the meeting of the decorative panel edges of each wall panel is also shown.
Figure 3:
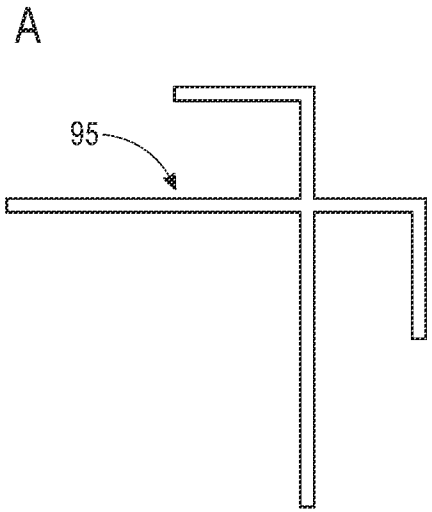

Once the first and second panels 60, 60' are inserted into the inside corner molding piece 50 (FIG. 2), the opposing ends of each of these panels 60, 60' will have a PCC 30 (FIG. 5) inserted, i.e., a PCC will be placed (inserted) on the edge of the panel. Panels can be serially added in either or both directions by inserting a PCC into the vertical or horizontal edges of each panel, fastening the PCC to the wall, and sliding the panels together to join via push click. While installing the paneling system of the present invention, if one reaches an exterior (outside) corner, i.e., a corner that is not inverted (rightmost portion of FIG. 1, which shows a corner of a fourth wall plane), the installer will use an outside corner molding 95 as shown in FIG. 3. This outside corner molding has two intersecting sides which are perpendicular to each other, the first side having a first tongue portion extending therefrom, said first tongue parallel to the second side, and the second side having a second tongue portion extending therefrom, said second tongue parallel to the first side. Using the outside corner molding 95, an installer will perform similar operations as described above for the inside corner molding 50. In this regard, a first panel will have one vertical edge profiled so that the decorative portion 80 of the panel 60" extends past the core 70 of the panel 60" and a slot is cut into the core 70 to receive a first tongue of the outside corner molding 95 (FIG. 3). A second panel is similarly profiled 60". The two panels are then installed so that the decorative portion 80 of each panel 60" extend to abut each other in the corner (FIG. 3). If the paneled area is to be made water impervious, then an outside corner seal 100 must be applied prior to securing the decorative panels in the corner molding. The outside corner seal has a square profile and fits into the square-shaped channel formed between the two tongue portions of the first and second sides of the outer corner molding and the core-facing sides of the decorative surfaces of the first and second wall panels. FIG. 3. It extends the length of the outside corner molding and can be made of the same materials described above for the inside corner seal. This outside corner seal 100 prevents water seepage.

The top edges of panels may extend to the ceiling or end several inches lower that the start of the ceiling. As shown in FIG. 1, when the top of the edge of the wall panels end about several inches lower that the start of the ceiling, a PCC is inserted into the top horizontal edge of the panel, which has a profile to receive the PCC, as described previously for wall panels. The PCC is then mechanically fastened to the wall. Trim 22 is inserted in the top edge of the PCC 30 to meet the ceiling as illustrated in FIG. 1. The trim can have straight or rounded edges and is made of the same type of material as the wall panels, in the same thickness, and with the same push click technology discussed above for the wall panels. Once installation is complete, the bottom seal, PCCs and corner moldings are covered and hidden by trim 22, trim molding 20 (FIG. 1) and decorative side of the wall panels 80 (FIGS. 2-5).

Using the various components of the wall paneling system, there is provided a method of covering a wall, which entails placing a first PCC over a vertical or horizontal edge of a first wall panel; pushing the first wall panel towards the wall; mechanically fastening the first PCC to the wall; placing a second PCC on the opposite vertical or horizontal edge of the first wall panel; pushing the panel towards the wall; and fastening the second PCC to the wall. In this method, a small area may be covered with just one wall panel. If desired, trim or trim molding may be inserted in the first and second PCC. Usually however, a larger wall area is covered with multiple panels.

To cover a larger area, after a first panel is fastened to the wall, a third PCC may be placed over a vertical or horizontal edge of a second wall panel, and then the second wall panel is joined to the first panel and second PCC. The second panel is slightly pushed towards the wall and then the third PCC is mechanically fastened to the wall.

In this manner, additional panels may be added to the vertical or horizontal axis of a wall. In other words, additional wall panels may be serially added by inserting additional PCCs into the vertical or horizontal edges of the additional wall panels, and fastening the PCCs to the wall after pushing each additional wall panel towards the wall.

Adjoining walls that meet at an interior corner are covered with wall panels by mechanically fastening an inside corner molding onto one or both walls meeting in the interior corner; sliding one panel that meets in the interior corner and having a vertical core edge with a groove profiled into the inside corner molding so that the tongue portion of the inside corner molding is inserted into the groove. If the wall area is being made impervious to water, an inside corner seal is first inserted before sliding the first wall panel into the corner molding. Another wall panel that meets in the interior corner is slid into the first inside corner molding so that it is flush against the one side of the inside corner molding having the tongue portion extending therefrom. A first additional PCC is placed on the exposed edge of the first panel that meets in the interior corner. A second additional PCC is placed on the exposed edge of the second panel that meets in the interior corner. The panels are pushed towards the wall. The first and second additional PCCs are mechanically fastened the to the walls. Additional panels and PCCs may be serially added in either or both directions away from the inside corner molding until a desired area of wall is covered. In this embodiment, the order that the panels are inserted could be reversed, i.e., the first panel to be inserted can be flush against the one side of the corner molding having the tongue portion extending therefrom, and the second panel to be inserted could be one that has a vertical core edge with a groove profiled therein to receive the tongue of the inside corner molding.

Adjoining walls that meet at an exterior corner are covered with wall panels by mechanically fastening an outside corner molding onto the exterior corner, i.e., one or both walls meeting in the exterior corner. If the wall area is being made impervious to water, an outside corner seal 100 is inserted into the square shaped channel formed between the two tongue portions of the first and second sides of the outside corner molding and the core-facing sides of the decorative surfaces of the first and second wall panels. A first wall panel that meets in the exterior corner and having its vertical core edge with a groove profiled therein, is slid into the outside corner molding so that the tongue portion of the outside corner molding is inserted into the groove profiled on the core edge of the panel. A second wall panel that meets in the exterior corner and having its vertical edge with a groove profiled therein is slid into the outside corner molding so that the tongue of the outside corner molding is inserted into the groove. A first PCC is placed on the exposed edge of the first panel that meets in the interior corner and a second PCC is placed on the exposed edge of the second panel that meets in the interior corner. The panels are pushed towards the walls and the first and second PCCs are fastened to the walls. Additional panels and PCCs may be serially added in either or both directions until a desired area of wall is covered.

An alcove bath or shower area having three adjoining walls and two interior corners, e.g., two side walls and one back wall (FIG. 1), may be paneled and made waterproof by running a rubbery bottom seal along the surface of a tub ledge, shower base or floor, at an edge nearest the three walls; placing a sealant on top of the rubber seal and mechanically fastening a first inside corner molding in a first interior corner. This first interior corner could be the rightmost or leftmost interior corner. As described above, the inside corner molding has two sides, each side fastenable to one or both adjoining walls, wherein a tongue portion extends from and is parallel to one side of the inside corner molding. A sealant is run along the length of the first inside corner molding and a first panel is slid into the first inside corner molding so that the first panel is flush against the one side of the inside corner molding having the tongue portion extending therefrom. This first panel is configured on the lower portion of its wall-facing side to rest upon the rubbery bottom seal and the first panel is slightly pushed towards the first wall. A first PCC is placed on an edge of the first panel, which edge is opposite the edge inserted into the first corner molding. A sealant is run in a groove (space) 37 on the edge of the first panel (FIG. 5), the groove running the length of the first panel. The first PCC is mechanically fastened to the back wall. A first inside corner seal is inserted into a recess on the edge of a second wall panel and sealant is applied the length of a second inside corner molding. The second inside corner molding is placed (inserted) on the edge of the second wall panel, which is also configured on the lower portion of its wall-facing side to rest upon the rubbery bottom seal and having a profile on its edge to receive both the tongue portion of the second corner molding and the inside corner seal. This second inside corner molding is mechanically fastened in a second interior corner. The second wall panel is adjoined to the first wall panel and first PCC, which first wall panel has one edge inserted into the first corner molding and its opposite edge connected to the first PCC. In this way, the first and second panels cover the back wall.

A second PCC is placed on the edge of a third panel, the third panel to cover a first sidewall. This third panel is also configured on the lower portion of its wall-facing side to rest upon the rubbery bottom seal. Sealant is run in a groove (space) on the edge of the third panel (37, FIG. 5) the groove running the length of the third panel. The third panel is slid into the second inside corner molding so that said third panel is flush against the one side of the inside corner molding having the tongue extending therefrom and the third panel is slightly pushed towards the wall. The second PCC is mechanically fastened to the first side wall and trim molding preferably with finished edges is adjoined to the third panel and the second PCC. In this manner, one side wall is covered.

A second inside corner seal is inserted into a recess on the edge of a fourth wall panel and the fourth wall panel is slid into the first corner molding installed in the first inside corner, the fourth panel to cover the second side wall and having a profile along its edge to receive both the tongue portion of the of the first corner molding and an inside corner seal, the fourth panel also configured on the lower back portion of its wall-facing side to rest upon the rubbery bottom seal. In this manner, a second sidewall is covered.

The fourth panel is slightly pushed towards the wall and a third PCC is placed on the edge of the fourth panel. Sealant in run in the groove of the panel, the groove running the length of the fourth panel. The third PCC is mechanically fastened to the wall and trim molding, preferably with finished edges, is adjoined to the fourth panel and the third PCC, thus completing installation of the waterproof paneling system in an alcove bath or shower area.

The above description defines various embodiments of a wall paneling system, and method of installing the various embodiments of the wall paneling system, allowing a user to change and/or replace wall panels easily and efficiently. By using specially adapted seals and sealants, the paneled walls are easily made impervious to water. It should be understood that the foregoing description relates to exemplary embodiments of the invention and that modifications may be made without departing from the spirit and scope of the present invention.

The invention claimed is:

1. A wall paneling system comprising:

(a) a first panel connector clip (PCC) having a front extension portion, a back extension portion and a tongue portion, said PCC adapted to run along a vertical or horizontal axis of a wall and mechanically fastenable to the wall;

(b) a first wall panel comprising an inner core with a decorative surface attached to one side, wherein a first and second vertical edge or a first and second horizontal edge of the first wall panel has a profile with a first portion capable of being disposed between the front extension portion and the tongue portion of the first PCC, said first portion of the wall panel also having a first and second recess, said first recess configured to mate with a corresponding protrusion on an additional wall panel or trim, and said second recess configured to receive a lip of the additional wall panel or trim;

(c) a second PCC having the same structural features as the first PCC;

wherein the tongue portion of the first and the second PCCs keeps the first wall panel locked to the wall at a distance of from about 1/16 to about 1/8 of an inch from the wall and wherein the profile of the first vertical or first horizontal edge of the first wall panel allow the first wall panel to be joined to the first PCC and the profile of the second vertical or second horizontal edge of the first wall panel allow the first wall panel to be joined to the second PCC by pushing or sliding the first PCC and the second PCC in a direction coplanar to the first wall panel.

2. The wall paneling system of claim 1 further comprising a second wall panel and at least a third PCC, said at least third PCC having the same structural features as the first PCC and the second PCC, wherein the second wall panel or trim has a first vertical or first horizontal edge profile configured to rest on the back extension portion of the at least third PCC, said second wall panel or trim having a protrusion thereon, said protrusion configured to mate with the corresponding first recess of the first wall panel, said second wall panel having a first vertical or first horizontal edge profile further comprising a lip configured to insert into the second recess of the first wall panel; wherein the first recess of the first wall panel holds the second wall panel to the first panel by coupling with the protrusion on the second wall panel, and wherein the second wall panel is further secured to the first wall panel by the lip of the second wall panel when inserted into the second recess of the first wall panel and wherein the profile of the first vertical or first horizontal edge of the second wall panel allow the second wall panel to be joined to the second PCC and the first wall panel by pushing or sliding in a direction coplanar to the first wall panel, and the profile of the second vertical or second horizontal edge of the second wall panel allow the third PCC to be joined to the second wall panel by pushing or sliding in a direction coplanar to the second wall panel.

3. The wall paneling system of claim 2 wherein the inner core of the wall panels is composed of polyvinyl chloride (PVC) foam board, wood, wood composite, calcium carbonate PVC or PVC marble, and the decorative surface attached to the one side is made of porcelain or PVC marble.

4. The wall paneling system of claim 2 further comprising a bottom seal made of a rubbery material and installable to extend along the surface of a tub ledge, shower base, counter top, or along a floor, at an edge closest to a wall, wherein the bottom seal has a profile having a lower portion that is wider than an upper portion due to the lower portion having a radius or rounded profile, said bottom seal configured to receive and seal the lower edge of the first and/or second wall panels, said first or said first and second wall panels configured on the lower portion of its wall-facing side to rest upon the bottom seal.

5. The wall paneling system of claim 2 further comprising additional wall panels and additional PCCs, each additional PCC having the same structural features as the first, second and third PCCs, each additional wall panel having the same structural features as the second wall panel, said second wall panel having opposite first and second vertical or horizontal edge profiles in order to connect with each other and to the PCCs in serial fashion.

6. The wall paneling system of claim 5 further comprising a bottom seal made of a rubbery material and installable to extend along the surface of a tub ledge, shower base, counter top, or along a floor, at an edge closest to a wall, wherein the bottom seal has a profile having a lower portion that is wider than an upper portion due to the lower portion having a radius or rounded profile, said bottom seal configured to receive and seal the lower edge of the first and/or second wall panels, said first or said first and second wall panels configured on the lower portion of its wall-facing side to rest upon the bottom seal.

7. The wall paneling system of claim 1 wherein the inner core of the wall panel is composed of polyvinyl chloride (PVC) foam board, wood, wood composite, calcium carbonate PVC or PVC marble, and the decorative surface attached to the one side is made of porcelain or PVC marble.

8. A wall paneling system comprising:

a) a first and second panel connector clip (PCC) having a front extension portion, a back extension portion and a tongue portion, said first and said second PCCs adapted to run along a vertical or horizontal axis of a wall and mechanically fastenable to the wall;

(b) a first wall panel comprising an inner core with a decorative surface attached to one side, wherein a first vertical edge has a profile with a first portion capable of being disposed between the front extension portion and the tongue portion of the first PCC, and having a second vertical edge with a groove profiled therein;

(c) a second wall panel comprising an inner core with a decorative surface attached to one side, wherein a first vertical edge has a profile with a first portion capable of being disposed between the front extension portion and the tongue portion of the second PCC, (d) an inside corner molding, said inside corner molding joinable to the first wall panel and the second wall panel that meet in an interior corner, said inside corner molding having two adjoining sides forming a right angle, each of the adjoining sides adapted to run vertically along the length of, and mechanically fastenable to one or two adjoining corner walls, wherein a tongue portion of the inside corner molding extends from and is parallel to one side of the inside corner molding, said tongue portion of the inside corner molding insertable into the groove profiled into the second vertical edge on the first wall panel and wherein the second vertical edge of the second wall panel is profiled to fit flush within the inside corner molding.

9. The wall paneling system of claim 8 further comprising a bottom seal made of a rubbery material and installable to extend along the surface of a tub ledge, shower base, counter top, or along a floor, at an edge closest to a wall, wherein the bottom seal has a profile having a lower portion that is wider than an upper portion due to the lower portion having a radius or rounded profile, said bottom seal configured to receive and seal the lower edge of the first and/or second wall panels, said first or said first and second wall panels configured on the lower portion of its wall-facing side to rest upon the bottom seal.

10. The wall paneling system of claim 8 further comprising an inside corner seal wherein the wall panel having a groove profiled into the core of its vertical edge has an additional recess profiled in the core of the same vertical edge and abutting said groove, to receive the inside corner seal.

11. A wall paneling system comprising a) a first and second panel connector clip (PCC) having a front extension portion, a back extension portion and a tongue portion, said first and said second PCC adapted to run along a vertical or horizontal axis of a wall and mechanically fastenable to the wall;

(b) a first wall panel comprising an inner core with a decorative surface attached to one side, wherein a first vertical edge has a profile with a first portion capable of being disposed between the front extension portion and the tongue portion of the first PCC, and having a second vertical edge with a groove profiled therein;

(c) a second wall panel comprising an inner core with a decorative surface attached to one side, wherein a first vertical edge has a profile with a first portion capable of being disposed between the front extension portion and the tongue portion of the second PCC, and having a second vertical edge with a groove profiled therein;

(d) an outside corner molding, said outside corner molding joinable to the first wall panel and the second wall panel that meet at an exterior corner, said outside corner molding adapted to extend vertically along the length of, and mechanically fastenable to one or two adjoining corner walls, said outside corner molding having two intersecting sides which are perpendicular to each other, said first intersecting side having a first tongue portion extending therefrom, said first tongue portion parallel to the second intersecting side of the outside corner molding, and said second intersecting side having a second tongue portion extending therefrom, said second tongue portion parallel to the first intersecting side of the outside corner molding, said first tongue portion of the first intersecting side of the outside corner molding insertable into the groove profiled into the second vertical edge of the first wall panel and said second tongue portion of the second intersecting side of the outside corner molding insertable into the groove profiled into the second vertical edge of the second wall panel.

12. The wall paneling system of claim 11 further comprising a bottom seal made of a rubbery material and installable to extend along the surface of a tub ledge, shower base, counter top, or along a floor, at an edge closest to a wall, wherein the bottom seal has a profile having a lower portion that is wider than an upper portion due to the lower portion having a radius or rounded profile, said bottom seal configured to receive and seal the lower edge of the first and/or second wall panels, said first or said first and second wall panels configured on the lower portion of its wall-facing side to rest upon the bottom seal.

13. The wall paneling system of claim 11 further comprising an outside corner seal, said outside corner seal having a square profile and insertable into a square shaped channel formed between the two tongue portions of the first and second sides of the outside corner molding and the core facing sides of the decorative surfaces of the first and second wall panels.

14. A method of covering a wall with the wall paneling system of claim 1, said method comprising:

placing the first PCC over the first vertical or horizontal edge of the first wall panel;

pushing the first wall panel towards the wall;

mechanically fastening the first PCC to the wall;

placing the second PCC on the second vertical or horizontal edge of the first wall panel;

pushing the first wall panel towards the wall; and fastening the second PCC to the wall.

15. A method of covering a wall with the wall paneling system of claim 2, said method comprising:

placing the first vertical edge of the second wall panel adjacent to the second vertical edge of the first wall panel;

placing a third PCC on the second vertical edge of the second wall panel;

adjoining the second wall panel to the first wall panel and second PCC sliding or pushing in a direction coplanar to the first wall panel;

pushing the second wall panel to the wall;

mechanically fastening the third PCC to the wall.

16. A method of covering a wall according to claim 15 further comprising: serially adding additional wall panels by inserting additional PCCs into the vertical or horizontal edges of the additional wall panels;

adjoining each additional wall panel by sliding or pushing in a direction coplanar to the preceding wall panel; and fastening the additional PCCs to the wall after pushing each additional wall panel towards the wall.

17. The method of claim 16 wherein trim molding is connected to the first wall panel and the first PCC and/or the last wall panel and the last PCC in the series.

18. A method of covering adjoining walls with the wall paneling system of claim 8, said method comprising:

mechanically fastening the inside corner molding into a first inside corner;

sliding the first wall panel that meets in the interior corner and having the vertical edge with a groove profiled therein into the inside corner molding so that the tongue portion of the inside corner molding is inserted into the groove;

siding the second wall panel that meets in the interior corner into the first inside corner molding so that the second wall panel is flush against the one side of the inside corner molding having the tongue portion extending therefrom;

placing the first PCC on the second vertical edge of the first wall panel that meets in the interior corner;

placing the second PCC on the second vertical edge of the second wall panel that meets in the interior corner;

pushing the wall panels towards the walls;

mechanically fastening the first and second PCCs to the walls;

serially adding additional wall panels and additional PCCs until a desired area of the adjoining walls is covered.

19. A method of covering adjoining walls with the wall paneling system of claim 11, said method comprising:

mechanically fastening the outside corner molding onto an exterior corner;

sliding the first wall panel that meets in the exterior corner and having a second vertical edge with a groove profiled therein, into the outside corner molding so that the first tongue portion of the first intersecting side of the outside corner molding is inserted into the groove;

sliding the second wall panel that meets in the exterior corner and having a second vertical edge with a groove profiled therein, into the outside corner molding so that the second tongue portion of the second intersecting side of the outside corner molding is inserted into the groove;

placing a first PCC on the first vertical edge of the first wall panel that meets in the interior corner;

placing a second PCC on the first vertical edge of the second wall panel that meets in the interior corner;

pushing the wall panels towards the walls;

mechanically fastening the first and second PCCs to the walls;

serially adding additional wall panels and PCCs until a desired area of the adjoining walls is covered.

20. A method of installing a waterproof paneling system in an alcove bath or shower area having three adjoining walls and two interior corners, said adjoining walls comprising two side walls and one back wall, said method comprising:

running a rubbery bottom seal along an upper surface of a tub ledge, shower base or floor, at an edge nearest the three adjoining walls;

placing a sealant on top of the rubbery bottom seal;

mechanically fastening a first inside corner molding in a first interior corner, said inside corner molding having two adjoining sides forming a right angle, each adjoining side adapted to run vertically along the length of, and mechanically fastenable to one or both adjoining corner walls, wherein a tongue portion of the inside corner molding extends from and is parallel to one side of the inside corner molding;

running a sealant along the length of the first inside corner molding;

sliding a first wall panel into the first inside corner molding so that a first vertical edge of the first wall panel is flush against the one side of the inside corner molding having the tongue portion extending therefrom, said first wall panel configured on the lower portion of its wall facing side to rest upon the rubbery bottom seal;

pushing the first wall panel towards the first wall;

placing a first PCC on a second vertical edge of the first wall panel, said second vertical edge opposite the first vertical edge inserted into the first inside corner molding; said first PCC having a front extension portion, a back extension portion and a tongue portion, said PCC adapted to run along a vertical or horizontal axis of a wall and mechanically fastenable to the wall, running sealant in a groove profiled on the second vertical edge of the first wall panel, said groove running the length of the first wall panel;

mechanically fastening the first PCC to the back wall;

inserting a first inside corner seal into a recess profiled on the a first vertical edge of a second wall panel;

running sealant the length of a second inside corner molding;

inserting a second inside corner molding on the first vertical edge of said second wall panel, said second inside corner molding substantially identical to the first inside corner molding, said second wall panel configured on the lower portion of its wall-facing side to rest upon the rubbery bottom seal and having a profile on a first vertical edge to receive both the tongue portion of the second corner molding and the first inside corner seal;

mechanically fastening the second inside corner molding in a second, interior corner;

adjoining the second wall panel to the first wall panel and the first PCC, said first wall panel having the first vertical edge inserted into the first inside corner molding and the second vertical edge connected to the first PCC, said first and second wall panels covering the back wall;

placing a second PCC on the first vertical edge of a third wall panel, said second PCC having the same structural features as the first PCC, said third wall panel to cover a first sidewall, said third wall panel configured on the lower portion of its wall facing side to rest upon the rubbery bottom seal;

running sealant in a groove profiled on the first vertical edge of the third wall panel, said groove running the length of the third wall panel;

sliding the third wall panel into the second inside corner molding so that a second vertical edge of said third wall panel is flush against the one side of the second inside corner molding having the tongue portion extending therefrom;

pushing the third wall panel towards the wall;

mechanically fastening the second PCC to the first side wall;

adjoining trim molding to the third wall panel and second PCC;

inserting a second inside corner seal, substantially identical to the first inside corner seal into a recess profiled on the first vertical edge of a fourth wall panel;

sliding the fourth wall panel into the first corner molding installed in the first inside corner, said fourth wall panel to cover the second side wall and having a profile along its first vertical edge to receive both the tongue portion of the of the first inside corner molding and the inside corner seal, said fourth wall panel also configured on the lower back portion of its wall-facing side to rest upon the rubbery bottom seal;

pushing the fourth wall panel towards the wall;

placing a third PCC on the second vertical edge of the fourth wall panel; said third PCC substantially identical to the first and second PCCs;

running sealant in a groove profiled in the second vertical edge of the fourth wall panel, said groove running the length of the fourth wall panel;

fastening the third PCC to the wall; and adjoining trim molding to the fourth wall panel and third PCC.

21. The method of claim 20 further comprising attaching a PCC having the same structural features as the first, second, and third PCCs, to the top horizontal edge of each of the four wall panels, and adjoining trim to each of four wall panels and their corresponding PCCs.

* * * * *